US010167440B2

(12) United States Patent
Smythe

(10) Patent No.: US 10,167,440 B2
(45) Date of Patent: Jan. 1, 2019

(54) MARINE ENGINE LUBRICATION

(71) Applicant: INFINEUM INTERNATIONAL LIMITED, Abingdon (GB)

(72) Inventor: John H. Smythe, Wantage (GB)

(73) Assignee: INFINEUM INTERNATIONAL LIMITED (GB)

( * ) Notice: Subject to any disclaimer, the term of this patent is extended or adjusted under 35 U.S.C. 154(b) by 0 days.

(21) Appl. No.: 14/267,950

(22) Filed: May 2, 2014

(65) Prior Publication Data

US 2014/0326205 A1 Nov. 6, 2014

(30) Foreign Application Priority Data

May 3, 2013 (EP) ..... 13166425

(51) Int. Cl.
*C10M 137/10* (2006.01)
*C10M 163/00* (2006.01)

(52) U.S. Cl.
CPC ..... *C10M 137/10* (2013.01); *C10M 163/00* (2013.01); *C10M 2203/1006* (2013.01); *C10M 2203/1025* (2013.01); *C10M 2207/262* (2013.01); *C10M 2223/045* (2013.01); *C10N 2210/02* (2013.01); *C10N 2220/027* (2013.01); *C10N 2230/06* (2013.01); *C10N 2230/08* (2013.01); *C10N 2230/26* (2013.01); *C10N 2240/102* (2013.01)

(58) Field of Classification Search
CPC ... C10M 2223/045; C10M 159/22; F02B 1/04
USPC ..... 508/370, 460; 123/1 A
See application file for complete search history.

(56) References Cited

U.S. PATENT DOCUMENTS

| | | | |
|---|---|---|---|
| 2005/0119140 | A1 | 6/2005 | Chambard et al. |
| 2008/0125337 | A1 | 5/2008 | Guinther et al. |
| 2012/0103299 | A1 | 5/2012 | Elvidge et al. |

*Primary Examiner* — Vishal V Vasisth

(57) ABSTRACT

Trunk piston marine engine crackcase lubrication is effected by a composition made by blending minor amounts of (A) a metal dithiophosphoric acid salt additive component comprising 50 mole % or more of a zinc di ($C_6$ primary alkyl) dithiophosphate, and (B) an overbased metal detergent additive component, with (C) a major amount of an oil of lubricating viscosity.

6 Claims, No Drawings

MARINE ENGINE LUBRICATION

FIELD OF THE INVENTION

This invention relates to the lubrication of 4-stroke marine diesel internal combustion engines, usually referred to as trunk piston engines. Lubricants therefor are usually known as trunk piston engine oils ("TPEO's").

BACKGROUND OF THE INVENTION

Trunk piston engines may be used in marine, power-generation and rail traction applications and have a higher speed than cross-head engines. A single lubricant (TPEO) is used for crankcase and cylinder lubrication. All major moving parts of the engine, i.e. the main and big end bearings, camshaft and valve gear, are lubricated by means of a pumped circulation system. The cylinder liners are lubricated partially by splash lubrication and partially by oil from the circulation systems that finds its way to the cylinder wall through holes in the piston skirt via the connecting rod and gudgeon pin. Trunk piston engines normally include a centrifuge to clean the TPEO.

Zinc dialkyl dithiophosphates ("ZDDP's") are known in the art as additives for TPEO's to provide wear protection for gears and valve train in trunk piston engines. However, the presence of water may destabilise the ZDDP molecule leading to depletion of phosphorus, the key element for provision of wear protection. Some ZDDP's may reduce phosphorus depletion but at the expense of FZG wear performance.

A problem in the art is therefore to provide ZDDP's in TPEO's that constitute a good balance between reducing phosphorus depletion in the presence of water and FZG wear performance.

SUMMARY OF THE INVENTION

It is now found that the use of ZDDP's of specific alkyl group chain length in a TPEO enables the above problem to be overcome.

Thus, the present invention provides in a first aspect a trunk piston marine engine lubricating oil composition of TBN in the range of 20 to 60, such as 30 to 55, for a medium-speed compression-ignited marine engine which comprises or is made by blending (A) an oil-soluble metal dithiophosphoric acid salt additive component, in a minor amount, which component comprises 50 mole % or more of a zinc dialkyl dithiophosphate where the alkyl group is a $C_6$ primary alkyl group; and (B) an oil-soluble overbased metal detergent additive component, in a minor amount; with (C) an oil of lubricating viscosity in a major amount.

In further aspects the present invention comprises:

The use of component (A), as defined in the first aspect of the invention, in a trunk piston marine lubricating oil composition for a medium-speed compression-ignited marine engine to control phosphorus depletion of the oil composition in the presence of water without adverse effect on the wear protection properties of the oil composition, when compared with the performance of analogous metal dithiophoric acid salts.

A method of operating a trunk piston medium-speed compression-ignited marine engine such as including a centrifuge comprising:

(i) fuelling the engine, such as with a heavy fuel oil; and (ii) lubricating the crankcase of the engine with a lubricating oil composition of the invention;

a method of making a trunk piston marine lubricating oil composition for a medium-speed compression-ignited marine engine compressing blending minor amounts of components (A) and (B), as defined in the first aspect of the invention, with a major amount of an oil of lubricating viscosity (C); and a trunk piston marine lubricating oil composition obtainable by the above method of this invention.

In this specification, the following words and expressions, if and when used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 mass % or more, preferably 60 mass % or more, even more preferably 60 mass % or more, of a composition;

"minor amount" means less than 50 mass %, preferably less than 40 mass %, even more preferably less than 30 mass %, of a composition;

"TBN" means total base number as measured by ASTM D2896.

Furthermore in this specification, if and when used:

"calcium content" is as measured by ASTM 4951;

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention will now be discussed in more detail below.

Trunk Piston Marine Engine Lubricating Oil Composition ("TPEO")

A TPEO may employ 7-35, preferably 10-28, more preferably 12-24, mass % of a concentrate or additives package, the remainder being base stock (oil of lubricating viscosity). Preferably, the TPEO has a compositional TBN (using D2896) of 20-60, preferably 25 or 30-55.

The following may be mentioned as typical proportions of additives in a TPEO.

| Additive | Mass % a.i. (Broad) | Mass % a.i. (Preferred) |
|---|---|---|
| detergent(s) | 0.5-12 | 2-8 |
| dispersant(s) | 0.5-5 | 1-3 |
| anti-wear agent(s) | 0.1-1.5 | 0.5-1.3 |
| oxidation inhibitor | 0.2-2 | 0.5-1.5 |
| rust inhibitor | 0.03-0.15 | 0.05-0.1 |
| pour point dispersant | 0.03-1.15 | 0.05-0.1 |
| base stock | balance | balance |

When a plurality of additives is employed it may be desirable, although not essential, to prepare one or more additive packages comprising the additives, whereby several additives can be added simultaneously to the oil of lubricating viscosity to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function, in the final formulation when the additive package(s) is/are combined with a predetermined amount of base lubricant. Thus, compounds in accordance with the present invention may be admixed with small amounts of base oil or other compatible solvents together with other desirable additives to form additive packages containing active ingredients.

Additive Component (A)

Additive component (A) may comprise a dihydrocarbyl dithiophosphate metal salt wherein the metal may be an alkali or alkaline earth metal, or aluminium, lead, tin, molybdenum, manganese, nickel, copper, or, preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

At least 50 mole % of component (A) is a zinc alkyl dithiophosphate where the alkyl group is a $C_6$ primary alkyl group and may be represented by the following formula:

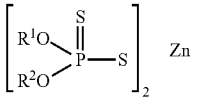

wherein $R^1$ and $R^2$ may be the same or different and are primary alkyl groups containing 6 carbon atoms, such as n-hexyl.

Preferably, at least 60, at least 70, at least 80, or at least 90, mole % of component (A) is the zinc dialkyl dithiophosphate. More preferably, all of component (A) is the zinc dialkyl dithiophosphate.

Preferably, (A) constitutes 0.1-1.5, such as 0.5-1.3, mass % of the TPEO.

Metal Detergent (B)

A detergent is an additive that reduces formation of deposits, for example, high-temperature varnish and lacquer deposits, in engines; it has acid-neutralising properties and is capable of keeping finely divided solids in suspension. It is based on metal "soaps", that is metal salts of acidic organic compounds, sometimes referred to as surfactants.

A detergent comprises a polar head with a long hydrophobic tail. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

The detergent is preferably an alkali metal or alkaline earth metal additive such as an overbased oil-soluble or oil-dispersible calcium, magnesium, sodium or barium salt of a surfactant selected from phenol, sulphonic acid, carboxylic acid, salicylic acid and naphthenic acid, wherein the overbasing is provided by an oil-insoluble salt of the metal, e.g. carbonate, basic carbonate, acetate, formate, hydroxide or oxalate, which is stabilised by the oil-soluble salt of the surfactant. The metal of the oil-soluble surfactant salt may be the same or different from that of the metal of the oil-insoluble salt. Preferably the metal, whether the metal of the oil-soluble or oil-insoluble salt, is calcium.

The TBN of the detergent may be low, i.e. less than 50 mg KOH/g, medium, i.e. 50-150 mg KOH/g, or high, i.e. over 150 mg KOH/g, as determined by ASTM D2896. Preferably the TBN is medium or high, i.e. more than 50 TBN. More preferably, the TBN is at least 60, more preferably at least 100, more preferably at least 150, and up to 500, such as up to 350 mg KOH/g, as determined by ASTM D2896.

Preferably, component (B) comprises an alkaline earth hydrocarbyl-substituted hydroxyl-benzoate salt such as a calcium alkylsalicylate salt.

The terms 'oil-soluble' or 'oil-dispersable' as used herein do not necessarily indicate that the compounds or additives are soluble, dissolvable, miscible or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricant compositions of this invention comprise defined individual (i.e. separate) components that may or may not remain the same chemically before and after mixing.

It may be desirable, although not essential, to prepare one or more additive packages or concentrates comprising the additives, whereby the additives can be added simultaneously to the oil of lubricating viscosity to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricant.

Thus, the additives may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

Oil of Lubricating Viscosity (C)

The lubricating oils may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., caster oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additional processing using techniques for removing spent additives and oil breakdown products.

The American Petroleum Institute (API) publication "Engine Oil Licensing and Certification System", Industry Services Department, Fourteenth Edition, December 1996, Addendum 1, December 1998 categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

Analytical Methods for Base Stock are tabulated below:

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

As examples of the above oils, there may be mentioned the Group I and Group II oils. Also, there may be mentioned those of the above oils containing greater than or equal to 90% saturates and less than or equal to 0.03% sulphur as the oil of lubricating viscosity, eg Group II, III, IV or V. They also include basestocks derived from hydrocarbons synthesised by the Fischer-Tropsch process. In the Fischer-Tropsch process, synthesis gas containing carbon monoxide and hydrogen (or 'syngas') is first generated and then converted to hydrocarbons using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. The syngas may, for example, be made from gas such as natural gas or other gaseous hydrocarbons by steam reforming, when the basestock may be referred to as gas-to-liquid ("GTL") base oil; or from gasification of biomass, when the basestock may be referred to as biomass-to-liquid ("BTL" or "BMTL") base oil; or from gasification of coal, when the basestock may be referred to as coal-to-liquid ("CTL") base oil.

Preferably, the oil of lubricating viscosity in this invention contains 50 mass % or more said basestocks. It may contain 60, such as 70, 80 or 90, mass % or more of said basestock or a mixture thereof. The oil of lubricating viscosity may be substantially all of said basestock or a mixture thereof.

It may be desirable, although not essential, to prepare one or more additive packages or concentrates comprising additives, whereby additives (A) and (B) can be added simultaneously to the oil of lubricating viscosity (C) to form the TPEO.

The final formulations as a trunk piston engine oil may typically contain 30, preferably 10 to 28, more preferably 12 to 24, mass % of the additive package(s), the remainder being the oil of lubricating viscosity. The trunk piston engine oil may have a compositional TBN (using ASTM D2896) of 20 to 60, such as, 30 to 55. For example, it may be 40 to 55 or 35 to 50. When the TBN is high, for example 45-55, the concentration of (A) may be higher. When the TBN is lower, for example 30 to below 45, the concentration of (A) may be lower.

The treat rate of additives (A) and (B) contained in the lubricating oil composition may for example be in the range of 1 to 2.5, preferably 2 to 20, more preferably 5 to 18, mass %.

Co-Additives

The lubricating oil composition of the invention may comprise further additives, different from and additional to (A) and (B). Such additional additives may, for example, include ashless dispersants, other metal detergents, other anti-wear agents such as anti-oxidants and demulsifiers.

EXAMPLES

The present invention is illustrated by but not limited to the following examples.

TPEO'S

A set of TPEO's was formulated each containing the same detergents in the same proportions and having a TBN of about 40. The TPEO's differed from one another solely in containing different zinc dialkyl dithiophosphates (ZDDP's) in the proportions indicated in the tables of results below. Each TPEO contained, as the balance, a major amount of a Group II oil of lubricating viscosity (Jurong 500N).

Testing & Results

Each TPEO was tested for phosphorus depletion in a centrifuge test, and for wear performance in an FZG test. The centrifuge test was conducted in an Alfa Lavel MAB103B 2.0 centrifuge. The TPEO was contaminated with a fixed amount of water and then cycled through the centrifuge. Samples of the TPEO were taken at regular intervals and analysed by inductively coupled plasma (ICP) mass spectrometry to determine the level of phosphorus remaining in the oil. The FZG test is an industry standard identified variously under the codes CEC L-07-A-95, ASTM D5182 and ISO 14635-1:2000.

TABLE 1

(Phosphorus Depletion Test)

| ZDDP/Mass % | Fresh | 5 | 10 | 20 | 25 | 50 | 90 |
|---|---|---|---|---|---|---|---|
| A $C_4/C_5$ 0.50 | 0.0472 | 0.0167 | 0.0166 | 0.0162 | 0.0165 | 0.0161 | 0.0151 |
| B $C_8/C_4/C_5$ 0.50 | 0.0436 | 0.0147 | 0.0147 | 0.0154 | 0.0157 | 0.0158 | 0.016 |
| C Primary $C_8$ 0.57 | 0.0508 | 0.0433 | 0.0435 | 0.0479 | 0.0473 | 0.0514 | 0.05 |
| 1 Primary $C_6$ 0.59 | 0.0436 | 0.0368 | 0.033 | 0.0326 | 0.0334 | 0.0374 | 0.0377 |

The identity of the alkyl groups in each ZDDP is indicated in the ZDDP/Mass % volume column.

Results are reported, as mass % P, at the beginning ("Fresh") and after the indicated number of minutes. A higher mass % P indicates superior performance. The TPEO of the invention (Example 1) is better than comparison TPEO Examples A and B but inferior to comparison TPEO Example C.

TABLE 2

(Wear Test)

| ZDDP/mass % | FZG |
|---|---|
| A $C_4/C_5$ 0.50 | 10 |
| B $C_8/C_4/C_5$ 0.50 | 11 |
| C Primary $C_8$ 0.57 | 8 |
| 1 Primary $C_6$ 0.59 | 11 |

A higher FZG value indicates a superior performance. Thus, the TPEO of the invention (Example 1) exhibits wear performance that is comparable to that of comparison TPEO Examples A and B and is better than that of comparison TPEO Example C.

Considering TABLES 1 and 2 together, the best combined P depletion and wear performance is provided by the TPEO of the invention (i.e. Example 1).

What is claimed is:

1. A trunk piston marine engine lubricating oil composition of TBN in the range of 20 to 60 mg KOH/g for a medium-speed compression-ignited marine engine which comprises or is made by blending (A) an oil-soluble metal dithiophosphoric acid salt additive component, in a minor amount, which component consists essentially of zinc dialkyl dithiophosphate where the alkyl group is a $C_6$ primary alkyl group; and (B) an oil-soluble overbased metal detergent additive component, in a minor amount; with (C) an oil of lubricating viscosity in a major amount.

2. The lubricating oil composition of claim 1, wherein component (B) comprises an alkaline earth hydrocarbyl-substituted hydroxy-benzoate salt.

3. The lubricating oil composition of claim 2, wherein the hydroxyl-benzoate salt is a calcium alkylsalicylate salt.

4. The lubricating oil composition of claim 1, wherein the oil of lubricating viscosity comprises 50 mass or more of a basestock containing greater than or equal to 90% saturates and less than or equal to 0.03% sulphur.

5. The lubricating oil composition of claim 4, wherein the basestock is a Group II basestock.

6. A method of operating a trunk piston medium-speed compression-ignited marine engine such as including a centrifuge comprising:

(i) fuelling the engine, such as with a heavy fuel oil; and (ii) lubricating the crankcase of the engine with al lubricating oil composition of claim 1.

* * * * *